US008860309B2

(12) United States Patent
Huang

(10) Patent No.: US 8,860,309 B2
(45) Date of Patent: Oct. 14, 2014

(54) MULTI-TUBULAR LED LIGHT BULB

(75) Inventor: David Huang, Taipei (TW)

(73) Assignee: Liquidleds Lighting Corp., Taipei City (TW)

( * ) Notice: Subject to any disclaimer, the term of this patent is extended or adjusted under 35 U.S.C. 154(b) by 596 days.

(21) Appl. No.: 13/173,000

(22) Filed: Jun. 30, 2011

(65) Prior Publication Data

US 2012/0194071 A1 Aug. 2, 2012

(30) Foreign Application Priority Data

Jan. 31, 2011 (TW) ..... 100202259 U

(51) Int. Cl.
*H01J 7/44* (2006.01)
*F21K 99/00* (2010.01)
*F21Y 105/00* (2006.01)

(52) U.S. Cl.
CPC ..... *F21K 9/13* (2013.01); *F21Y 2105/005* (2013.01)
USPC ..... 315/35; 315/113; 315/250

(58) Field of Classification Search
USPC ..... 362/362–363, 800
See application file for complete search history.

(56) References Cited

U.S. PATENT DOCUMENTS

| | | | | |
|---|---|---|---|---|
| 5,806,965 | A * | 9/1998 | Deese | 362/249.04 |
| 7,726,836 | B2 * | 6/2010 | Chen | 362/249.02 |
| 8,167,677 | B2 * | 5/2012 | Huang | 445/44 |
| 2004/0095072 | A1 * | 5/2004 | Sudou et al. | 315/1 |
| 2011/0063835 | A1 * | 3/2011 | Rivas et al. | 362/235 |
| 2011/0163675 | A1 * | 7/2011 | Lin et al. | 315/113 |
| 2011/0169408 | A1 * | 7/2011 | Chen et al. | 315/51 |

* cited by examiner

*Primary Examiner* — Douglas W Owens
*Assistant Examiner* — Henry Luong
(74) *Attorney, Agent, or Firm* — Alan Kamrath; Kamrath IP Lawfirm, P.A.

(57) ABSTRACT

The multi-tubular LED light bulb has a seat having a power plug, multiple glass tubes mounted on the seat, multiple multi-directional lighting LED strips respectively mounted inside the glass tubes and an AC to DC converting circuit board mounted inside the seat and connected to the power plug to obtain AC power and converting the AC power to DC power. The multi-directional lighting LED strips are electronically connected to the DC power source from the AC to DC converting circuit in parallel. Since the LED light bulb has multiple multi-directional lighting LED strips, different directional sightings and even brightness are provided. Further, heat from the LED strip is easily and quickly transmitted to the sidewall of the glass tube to extend the lifetime of the LED light bulb, since the multi-directional lighting LED strips are close to a sidewall of the corresponding glass tube.

16 Claims, 7 Drawing Sheets

MULTI-TUBULAR LED LIGHT BULB

BACKGROUND OF THE INVENTION

1. Field of the Invention

The present invention relates to the field of an LED light bulb and, more particularly, to a multi-tubular LED light bulb.

2. Description of Related Art

The LED has the characteristic of lower energy consumption and is therefore used as a light source of the illuminator. The traditional light source of the illuminator is replaced with the LED. With reference to FIG. 6, a conventional LED illuminator is an LED light bulb having a circular printed circuit board 50 and multiple LEDs 51 mounted on the circular printed circuit board.

Since the LED of the LED light bulb has a directional lighting characteristic and since all of the LEDs are mounted on a same face of the circular printed circuit board, the LED light bulb provides lighting in only one direction and limits an illuminating range. In addition, the LED light bulb does not provide high brightness, since the area of the face of the circular printed circuit board is too small and since the number of the LEDs is limited.

To overcome the shortcomings, the present invention provides a multi-tubular LED light bulb to mitigate or obviate the aforementioned problems.

SUMMARY OF THE INVENTION

The main objective of the present invention is to provide a multi-tubular LED light bulb having high and even brightness.

The multi-tubular LED light bulb has a seat having a power plug, multiple glass tubes mounted on the seat, multiple multi-directional lighting LED strips respectively mounted inside the glass tubes and an AC to DC converting circuit board mounted inside the seat and connected to the power plug to obtain AC power and converting the AC power to DC power. The multi-directional lighting LED strips are electronically connected to the DC power source from the AC to DC converting circuit in parallel. Since the LED light bulb has multiple multi-directional lighting LED strips, different directional lightings and even brightness are provided. Further, heat from the LED strip is easily and quickly transmitted to the sidewall of the glass tube to extend the lifetime of the LED light bulb, since the multi-directional lighting LED strips are close to a sidewall of the corresponding glass tube.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
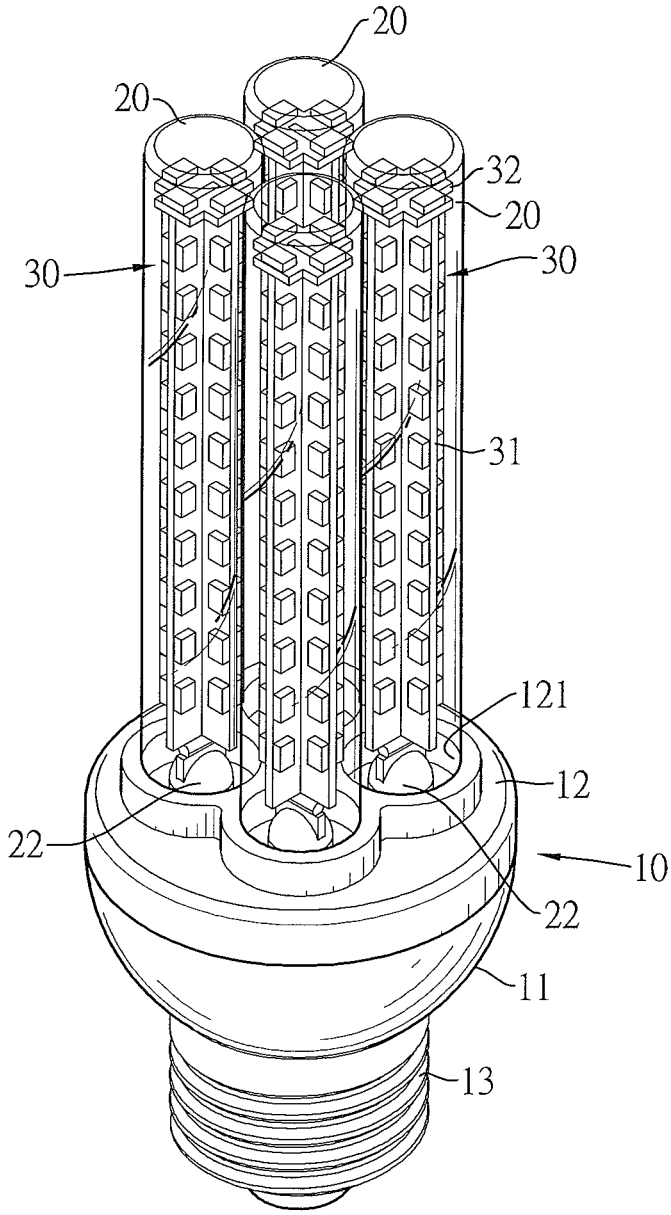
FIG. 1 is a perspective view of a multi-tubular LED light bulb in accordance with the present invention.
Figure 2:
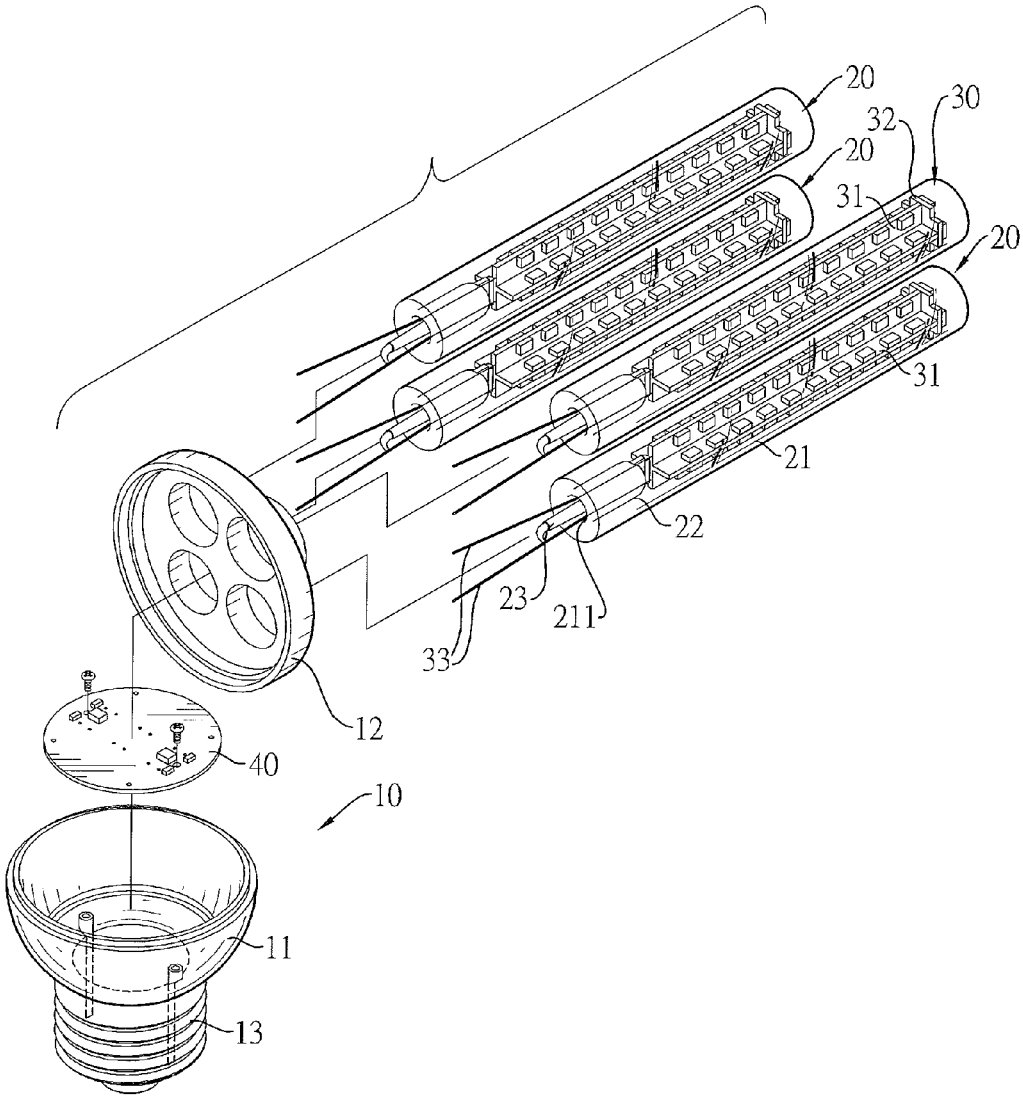
FIG. 2 is an exploded perspective view of the multi-tubular LED light bulb in accordance with the present invention.
Figure 3A:
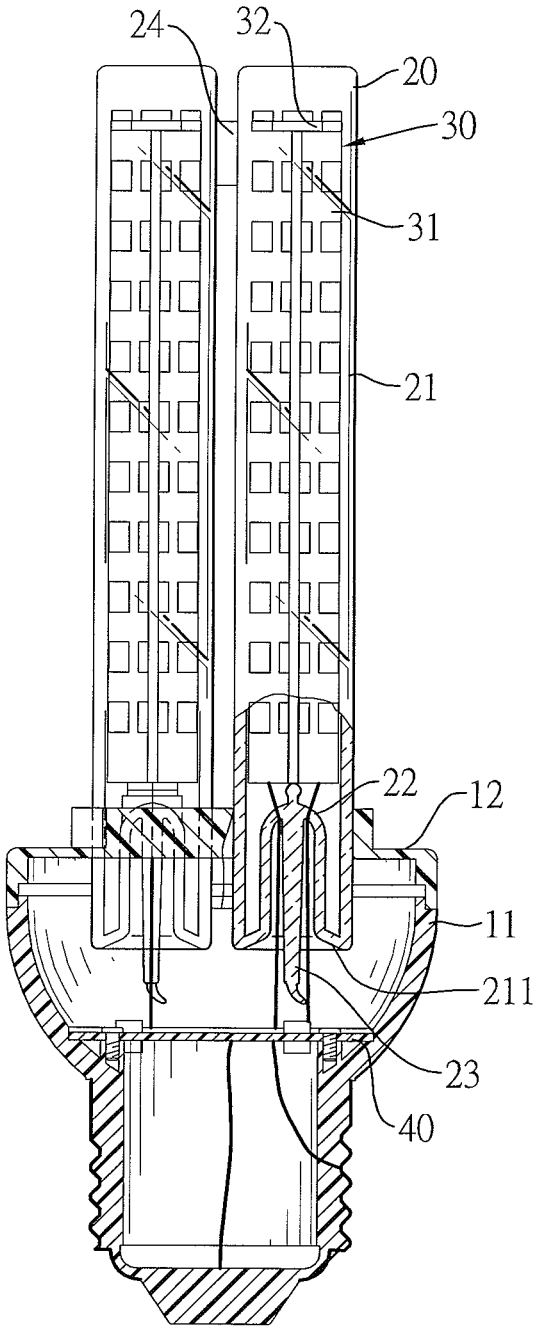
FIG. 3A is a partial cross sectional view of FIG. 1.

With reference to FIG. 1, FIG. 2 and FIG. 3A, a first embodiment of a multi-tubular LED light bulb has a seat 10, multiple glass tubes 20, multiple multi-directional lighting LED strips 30, and an AC to DC converting circuit board 40.

Figure 3B:
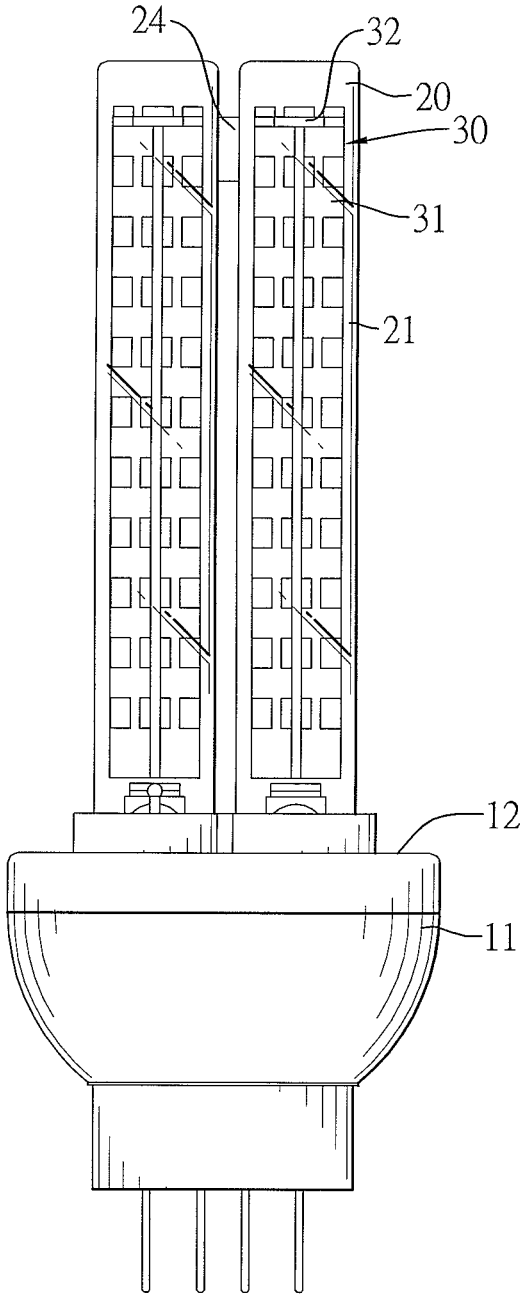
FIG. 3B is a side plan view of another multi-tubular LED light bulb in accordance with the present invention.

The seat 10 has a hollow base 11, a cover 12 and a power plug 13. The hollow base 11 has a top opening covered by the cover 12. Multiple through holes 121 are defined through the cover 12. The power plug 13 is mounted on a bottom of the hollow base 11. In the first embodiment, the type of the power plug is an Edisson screw including E27, E14, B22, etc. With further reference to FIG. 3B, another embodiment of an LED light bulb may use the type G7, G10, G11, G23, G24, etc. pin plug as a power plug.

The glass tubes 20 are respectively inserted into the corresponding through holes 121 of the seat 10, so that a bottom portion of each glass tube 20 is mounted on the seat 10. In the first embodiment, the LED light bulb 10 has four glass tubes 20 and further has four supports 24 respectively connected between the exteriors of the two corresponding adjacent glass tubes 20. The support 24 may maintain a fixed gap between the two adjacent glass tubes 20. Each of the at least one support 24 has a length matching a distance between the two through holes 121, where the corresponding adjacent glass tubes 20 are inserted. Each glass tube 20 has a cylinder body 21, a bell-shaped bubble 22 and an airtight pipe 23. The bell-shaped bubble 22 is received inside the cylinder body 21 from a bottom opening 211, and a bottom of the bell-shaped bubble 22 is integrally connected to the bottom edge of the cylinder body 21. The bottom edge is formed around the bottom opening 211. The airtight pipe 23 downwardly extends from a top of the bell-shaped bubble 22 and communicates with an inner space of the cylinder body 21.

Figure 5A:
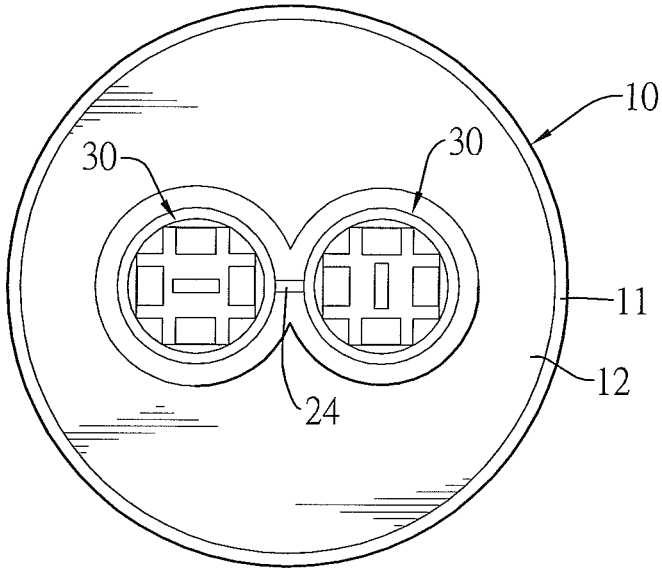
FIG. 5A is a top plan view of another multi-tubular LED light bulb in accordance with the present invention.
Figure 5B:
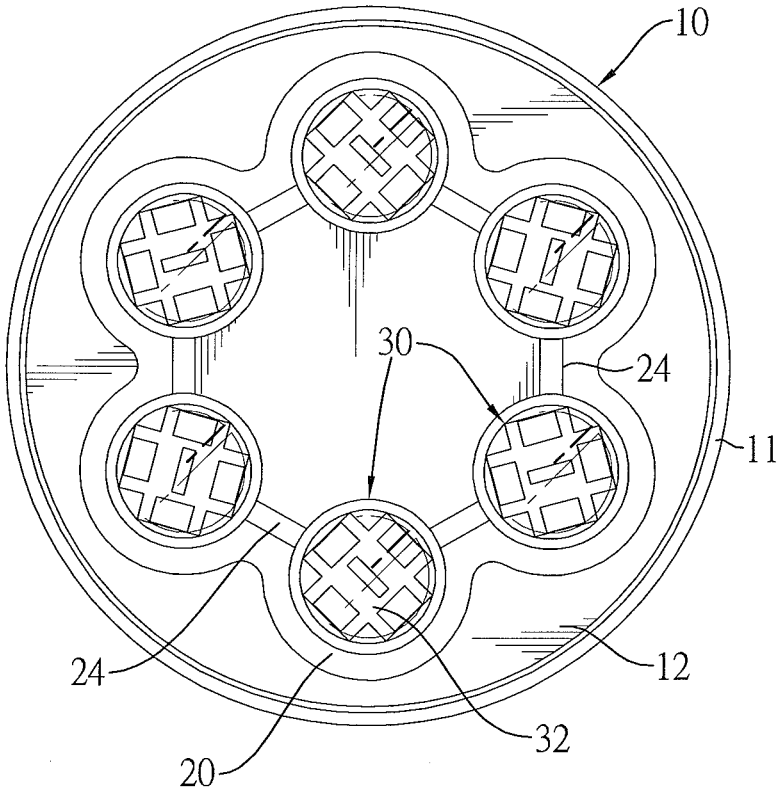
FIG. 5B is a top plan view of another multi-tubular LED light bulb in accordance with the present invention.
Figure 6:
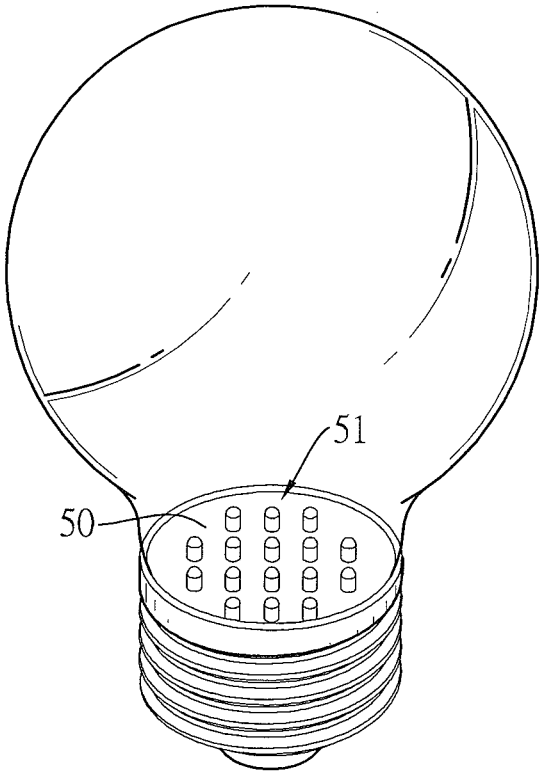
FIG. 6 PRIOR ART
FIG. 6 is a perspective view of a conventional LED light bulb in accordance with the prior art.

Multiple multi-directional lighting LED strips 30 are respectively mounted inside the glass tubes 20. Each multi-directional lighting LED strip 30 is mounted inside the corresponding glass tube 20 and has multiple lengthwise LED circuit boards 31, a lateral LED circuit board 32 and two power pins 33. In the preferred embodiment, four LED lengthwise circuit boards 31 are arranged in a cross shape, and the lateral LED circuit board 32 is mounted across top of the lengthwise LED circuit boards 31. The power pins 33 are mounted on the lengthwise LED circuit boards 31 and pass outside the bottom opening 211 of the glass tube 20. In a preferred embodiment, two power pins 33 pass through a gap between the bell-shaped bubble 22 and the airtight pipe 23 and protrude outside the bottom opening 211 of the glass tube 20. Since multiple LEDs are mounted on two opposite sides of the lengthwise LED circuit boards 31, each lengthwise LED circuit 31 has two opposite lighting faces. Therefore, the multi-directional lighting LED strip 30 provides different directional lightings to have a boarder lighting area. With further reference to FIGS. 5A and 5B, two or six multi-directional lighting LED strips 30 and glass tubes 20 are used in the present invention. The present invention does not limit numbers of the multi-directional lighting LED strips and the glass tubes.

Figure 4:
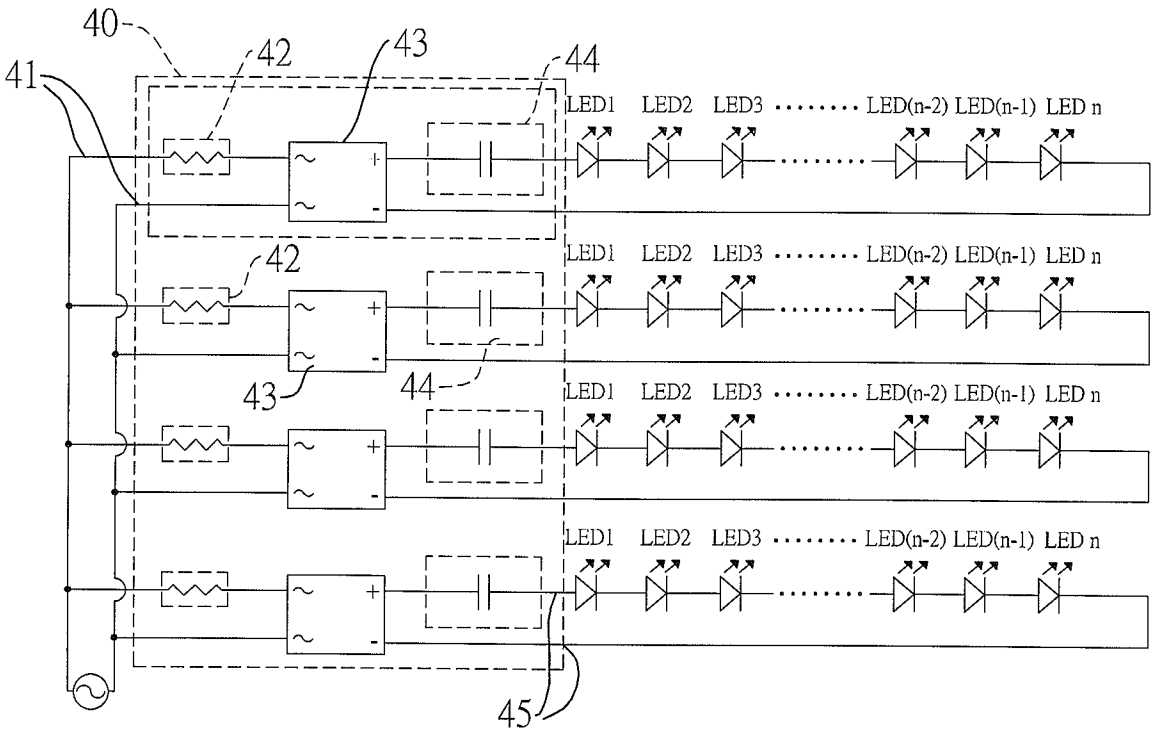
FIG. 4 is a detailed circuit diagram of an AC to DC converting circuit board of the multi-tubular bulb in accordance with the present invention.

With further reference to FIG. 4, the AC to DC converting circuit board 40 is mounted in the hollow base 11 of the seat 10 and has AC power inputs 41 and DC power outputs 45. The AC power inputs 41 are connected to the power plug 13. The power pins 33 are connected to the DC power outputs 45, so the multi-directional lighting LED strips 30 are electronically connected to the DC power outputs 45 in parallel. The AC to DC converting circuit board 40 has multiple AC to DC power converters. Each AC to DC power converter has a current limiting resistor 42, a full bridge rectifier 43 and a capacitor 44. Inputs of the full bridge rectifier 43 are connected to the AC power inputs 41. The current limiting resistor 42 is connected between one of the AC power inputs 41 and one of the inputs of the full bridge rectifier 43, so the full bridge rectifier 43 obtains AC power from the power plug 13. Outputs of the full bridge rectifier 43 are connected to the DC power outputs 45. The capacitor 44 is connected between one of the outputs of the full bridge rectifier 43 and one of the DC power outputs 45. The full bridge rectifier 43 converts the AC power to the DC power and then outputs the DC power to the DC power outputs 45. The multi-directional lighting LED strips 30 are electronically connected to the DC power source in parallel to establish multiple parallel loops, so that each multi-directional lighting LED strip 30 can be lit individually.

In addition, the inner space of the glass tube 20 may be further filled with gas having a high heat conductive coefficient, such as an inert gas including neon or argon, or nitrogen. To draw the gas in the inner space of the glass tube 20, the multi-directional lighting LED board 30 is inserted into the inner space of the glass tube 20 from the bottom opening 211 thereof before forming the bell-shaped bubble and the airtight pipe. When the multi-directional lighting LED strip 30 is mounted inside the inner space of the glass tube 20, a preformed bell-shaped bubble 22 with a pipe having an opening is heated to adhere to the bottom edge of the cylinder body 21. Air in the inner space is drawn from the opening of the pipe until the inner space is under vacuum. After then, the gas having high heat conductive coefficient is inserted into the inner space through the opening of the pipe 23 to prevent metal material on the circuit boards from being oxidized and to extend the lifetime of the circuit boards. In the final step, the opening of the pipe 23 is heated to be closed to form the airtight pipe 23.

Based on the foregoing description, the LED light bulb has multiple multi-directional lighting LED strips and each LED strip has multiple lengthwise LED boards each having two lighting faces and a lateral LED board, so that the LED light bulb provides different directional lightings to have a boarder lighting area and high and even brightness. In addition, since the glass tube is long and since the multi-directional lighting LED strip is close to a sidewall of the glass tube, heat from the LED strip is easily and quickly transmitted to the sidewall of the glass tube to extend the lifetime of the LED light bulb.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A multi-tubular LED light bulb comprising:

a seat having a top defined with multiple through holes, a bottom and a power plug mounted on the bottom of the seat;

multiple glass tubes each having a bottom and a top opposite to the bottom of the corresponding glass tube, with the bottoms of the multiple glass tubes respectively inserted into the multiple through holes on the top of the seat and mounted on the seat;

multiple multi-directional lighting LED strips respectively mounted inside the glass tubes, wherein each multi-directional light LED strip has:

multiple lengthwise LED circuit boards each having two opposite lighting faces;

a lateral LED circuit board mounted on tops of the multiple lengthwise LED circuit boards located adjacent to the top of the corresponding glass tube; and two power pins mounted on the multiple lengthwise LED circuit boards and passing through the bottom of the corresponding glass tube;

an AC to DC converting circuit board mounted inside the seat and having:

AC power inputs connected to the power plug to receive AC power; and

DC power outputs where the power pins of the multi-directional lighting LED strips are connected, with the DC power outputs supplying DC power; wherein the multiple multi-directional lighting LED strips are electronically connected to a DC power source in parallel; and at least one support mounted between exteriors of the corresponding two adjacent glass tubes, with the at least one support being spaced from the seat and the multiple through holes to define a fixed gap between the corresponding two adjacent glass tubes and between the at least one support and the seat, wherein each of the at least one support has a length matching a distance between the two through holes, where the corresponding two adjacent glass tubes are inserted.

2. The LED light bulb as claimed in claim 1, wherein the seat comprises:

a hollow base having a top opening and the bottom on which the power plug is mounted; and a cover in which the multiple through holes are defined through, with the cover covering the top opening of the hollow base, wherein the multiple through holes communicate with an inner space of the hollow base.

3. The LED light bulb as claimed in claim 2, wherein each glass tube comprises:

a cylinder body defining the inner space, with the bottom of the cylinder body having a bottom opening and a bottom edge around the bottom opening;

a bell-shaped bubble received inside the cylinder body from the bottom opening, wherein a bottom of the bell-shaped bubble is integrally connected to the bottom edge of the cylinder body; and an airtight pipe downwardly extending from a top of the bell-shaped bubble and communicating with the inner space of the cylinder body.

4. The LED light bulb as claimed in claim 2, wherein the AC to DC converting circuit board has multiple AC to DC power converters, wherein each AC to DC power converter comprises:

a full bridge rectifier having inputs respectively and electronically connected to the AC power inputs, and outputs respectively and electronically connected to the DC power outputs;

a current limiting resistor electronically connected between one of the AC power inputs and one of the inputs of the full bridge rectifier; and a capacitor electronically connected between one of the outputs of the full bridge rectifier and one of the DC power outputs.

5. The LED light bulb as claimed in claim 2, wherein the power plug is an E27, E14 or B22 Edisson screw, or G7, G10, G11, G23 or G24 pin plug.

6. The LED light bulb as claimed in claim 3, wherein the inner space of the glass tube is filled with gas having a high heat conductive coefficient.

7. The LED light bulb as claimed in claim 3, wherein the AC to DC converting circuit board has multiple AC to DC power converters, wherein each AC to DC power converter comprises:

a full bridge rectifier having inputs respectively and electronically connected to the AC power inputs, and outputs respectively and electronically connected to the DC power outputs;

a current limiting resistor electronically connected between one of the AC power inputs and one of the inputs of the full bridge rectifier; and a capacitor electronically connected between one of the outputs of the full bridge rectifier and one of the DC power outputs.

8. The LED light bulb as claimed in claim 3, wherein the power plug is an E27, E14 or B22 Edisson screw, or G7, G10, G11, G23 or G24 pin plug.

9. The LED light bulb as claimed in claim 6, wherein the gas is inert gas or nitrogen.

10. The LED light bulb as claimed in claim 6, wherein the AC to DC converting circuit board has multiple AC to DC power converters, wherein each AC to DC power converter comprises:

a full bridge rectifier having inputs respectively and electronically connected to the AC power inputs, and outputs respectively and electronically connected to the DC power outputs;

a current limiting resistor electronically connected between one of the AC power inputs and one of the inputs of the full bridge rectifier; and a capacitor electronically connected between one of the outputs of the full bridge rectifier and one of the DC power outputs.

11. The LED light bulb as claimed in claim 6, wherein the power plug is an E27, E14 or B22 Edisson screw, or G7, G10, G11, G23 or G24 pin plug.

12. The LED light bulb as claimed in claim 9, wherein the AC to DC converting circuit board has multiple AC to DC power converters, wherein each AC to DC power converter comprises:

a full bridge rectifier having inputs respectively and electronically connected to the AC power inputs, and outputs respectively and electronically connected to the DC power outputs;

a current limiting resistor electronically connected between one of the AC power inputs and one of the inputs of the full bridge rectifier; and a capacitor electronically connected between one of the outputs of the full bridge rectifier and one of the DC power outputs.

13. The LED light bulb as claimed in claim 9, wherein the power plug is an E27, E14 or B22 Edisson screw, or G7, G10, G11, G23 or G24 pin plug.

14. The LED light bulb as claimed in claim 12, wherein the power plug is an E27, E14 or B22 Edisson screw, or G7, G10, G11, G23 or G24 pin plug.

15. The LED light bulb as claimed in claim 1, wherein the AC to DC converting circuit board has multiple AC to DC power converters, wherein each AC to DC power converter comprises:

a full bridge rectifier having inputs respectively and electronically connected to the AC power inputs, and outputs- respectively and electronically connected to the DC power outputs;

a current limiting resistor electronically connected between one of the AC power inputs and one of the inputs of the full bridge rectifier; and a capacitor electronically connected between one of the outputs of the full bridge rectifier and one of the DC power outputs.

16. The LED light bulb as claimed in claim 1, wherein the power plug is an E27, E14 or B22 Edisson screw, or G7, G10, G11, G23 or G24 pin plug.

* * * * *